US007445211B1

(12) United States Patent
Walton

(10) Patent No.: US 7,445,211 B1
(45) Date of Patent: Nov. 4, 2008

(54) WALL DECORATION AND GAME APPARATUS

(76) Inventor: Daniel J. Walton, 1495 373rd Ave. N., Stanchfield, MN (US) 55080

( * ) Notice: Subject to any disclaimer, the term of this patent is extended or adjusted under 35 U.S.C. 154(b) by 64 days.

(21) Appl. No.: 11/349,823

(22) Filed: Feb. 8, 2006

Related U.S. Application Data

(60) Provisional application No. 60/660,781, filed on Mar. 11, 2005.

(51) Int. Cl.
*A63F 3/00* (2006.01)

(52) U.S. Cl. ..... 273/291; 273/287

(58) Field of Classification Search ..... 273/287, 273/291, 236; D11/132
See application file for complete search history.

(56) References Cited

U.S. PATENT DOCUMENTS 5,085,608 A * 2/1992 Turner ..... 446/75

* cited by examiner

*Primary Examiner*—Vishu K. Mendiratta
(74) *Attorney, Agent, or Firm*—Dicke, Billig & Czaja

(57) ABSTRACT

A wall decoration and game apparatus that is convertible between a display mode for hanging on a wall and a game playing mode for playing a board game such as cribbage. The apparatus includes a mounting panel and a game board. The game board is releasably attachable to the mounting panel. The game board has a display side and a game playing side. The display side of the game board has a likeness of an animal such as a fish. In a display mode the game board is releasably attached to the mounting panel with the display side facing out and the mounting panel is hung on a wall. In game playing mode the game board is detached from the mounting panel. Legs are attached to the mounting panel and it becomes a stand for the game board with the game playing surface facing up. In the embodiment shown the game board is a cribbage game board and has a peg hole array for a cribbage game. The mounting panel has an open storage compartment that is covered by the game board in the display mode. Game components and stand legs can be stored in the compartment.

7 Claims, 9 Drawing Sheets

WALL DECORATION AND GAME APPARATUS

CROSS REFERENCE TO RELATED APPLICATION

This application claims the benefit of provisional patent application Ser. No. 60/660,781 filed Mar. 11, 2005.

BACKGROUND OF THE INVENTION

Cribbage is an example of a popular game using a playing board and playing equipment. Playing the game typically involves the use of a card deck, a cribbage board with a pattern of peg holes, and a number of pegs. These various components are best kept together for organizational purposes. Storage space for such items is sometimes at a premium or is inconvenient. The various items tend to get strewn about and lost or damaged.

At the same time wall decorations are popular. A popular wall decoration is a mounted animal or a replica of one. For example a popular wall decoration is a mounted fish. Such wall decorations and playing board games such as cribbage games are often found in the same vicinity such as at a vacation cabin or in the den of a home.

SUMMARY OF THE INVENTION

The invention pertains to a wall decoration and game apparatus. The apparatus is convertible between a display mode and a game playing mode. The apparatus includes a mounting panel and a game board. The game board is releasably attachable to the mounting panel. The game board has a display side and a game playing side. The display side of the game board has a likeness of an animal such as a fish. In a display mode the game board is releasably attached to the mounting panel with the display side facing out and the mounting panel is hung on a wall.

In game playing mode the game board is detached from the mounting panel. Legs are attached to the mounting panel and it becomes a stand for the game board with the game playing surface facing up. In the embodiment shown the game board is a cribbage game board and has a peg hole array for a cribbage game. The mounting panel has an open storage compartment that is covered by the game board in the display mode. Game components and stand legs can be stored in the compartment.

For use in the game mode the unit is removed from the wall. The game board is detached from the mounting panel. The stand legs stored in the compartment are removed and assembled to the mounting panel to form a stand for the game board. The display side is placed on the stand legs with the game playing surface facing up and available for use in the intended game fashion. If the intended game is cribbage, the cribbage pegs are removed from the compartment for game playing use.

DESCRIPTION OF PREFERRED EMBODIMENTS

Figure 1:
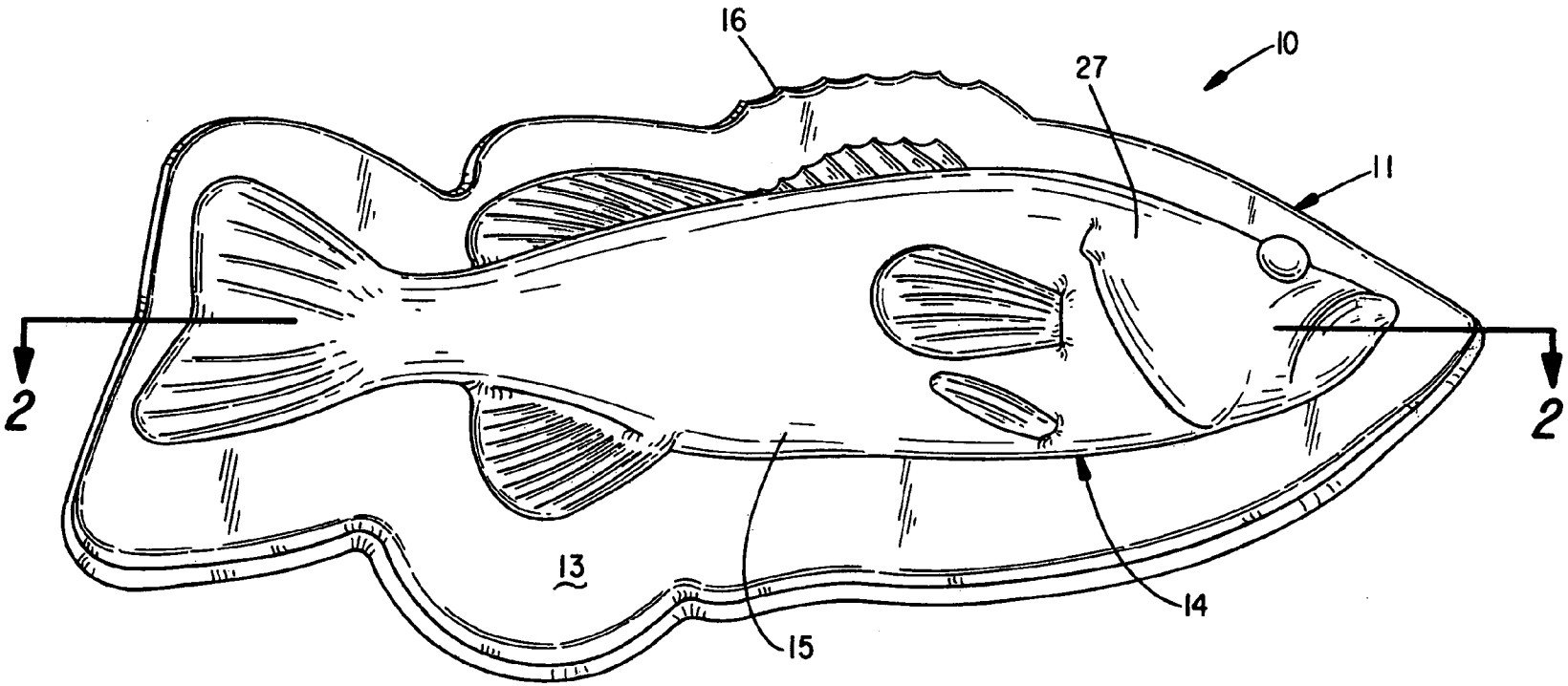
FIG. 1 is a front elevational view of an embodiment of a wall decoration and game board apparatus having a fish replica decoration.

Referring to the drawings, there is shown in FIG. 1 a wall decoration and game apparatus according to an embodiment of the invention indicated generally at 10 and shown in the display mode. Game apparatus 10 includes a base or mounting panel 11 having a back surface 12 that faces a wall when the apparatus 10 is hung on a wall, and a front mounting surface 13. Mounting panel 11 can be wood, plastic, metal or other suitable material. A game board indicated generally at 14 is releasably attached to the front surface 13 of the mounting panel 11. The game board 14 has a display surface 15 which faces outwardly when the game board 14 is attached to the mounting panel 11 and the apparatus is hung on a wall for display purposes. The game board 14 has a game playing surface 17 (FIGS. 2 and 5) which abuts the front surface 13 of the mounting panel 11 in the display mode of FIG. 1.

In the embodiment shown in FIG. 1, the display surface of the game board consists of a three dimensional rendition or relief of a fish, and in particular, in the likeness of the species of fish known as a walleye. The fish replica can be formed in any suitable manner such as by molding, carving, casting or the like. The outer perimeter 16 of the mounting panel 11 can generally follow the contour of the fish replica.

Figure 2:
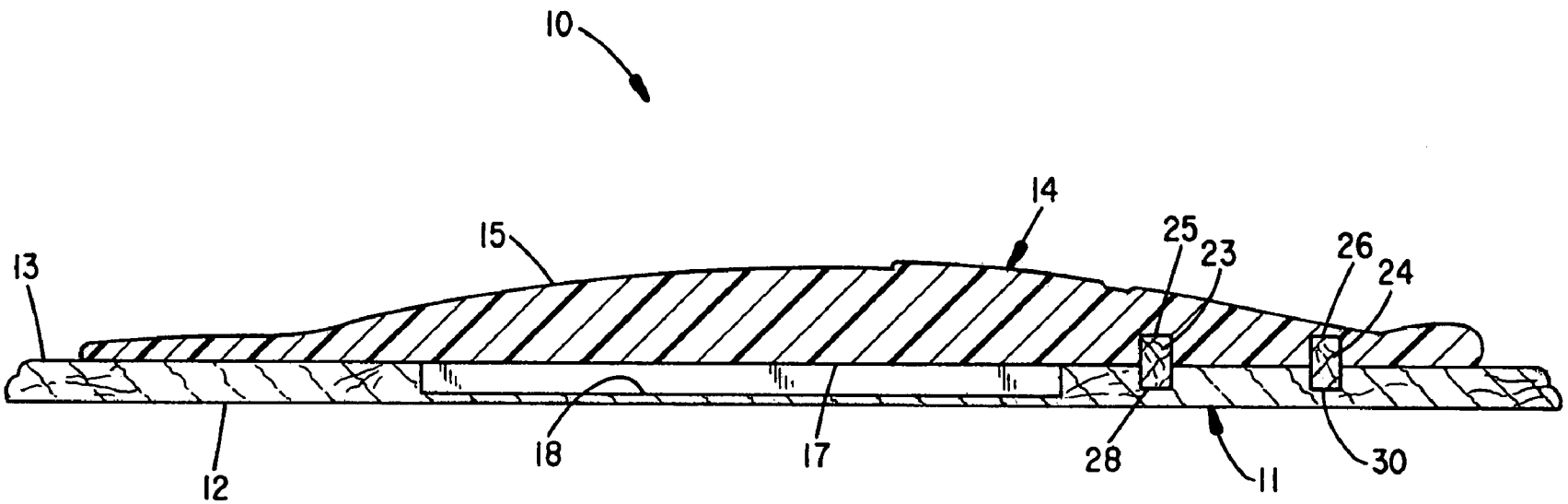
FIG. 2 is a sectional view of the wall decoration and game board apparatus of FIG. 1 taken along the line 2-2 thereof.
Figure 3:
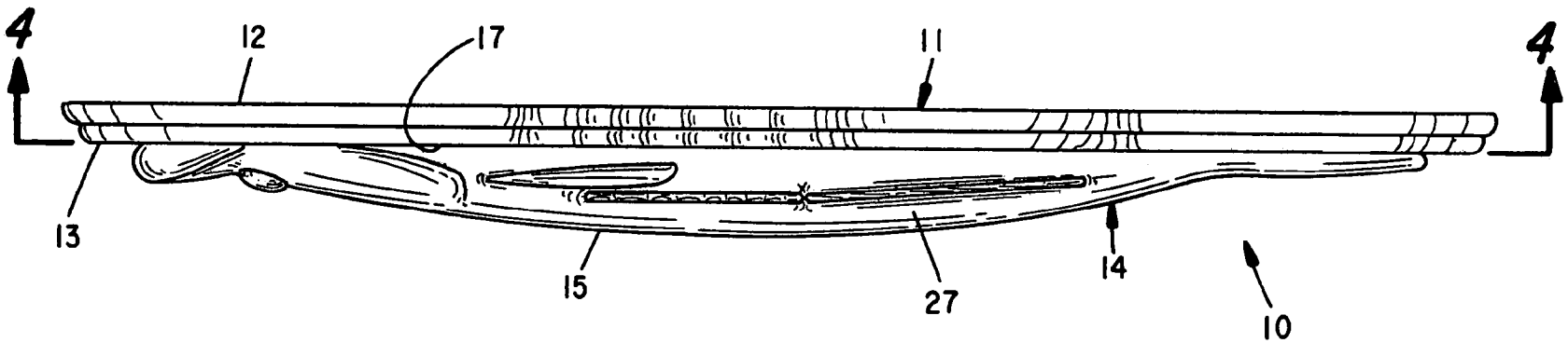
FIG. 3 top view of the wall decoration and game board apparatus of FIG. 1.
Figure 4:
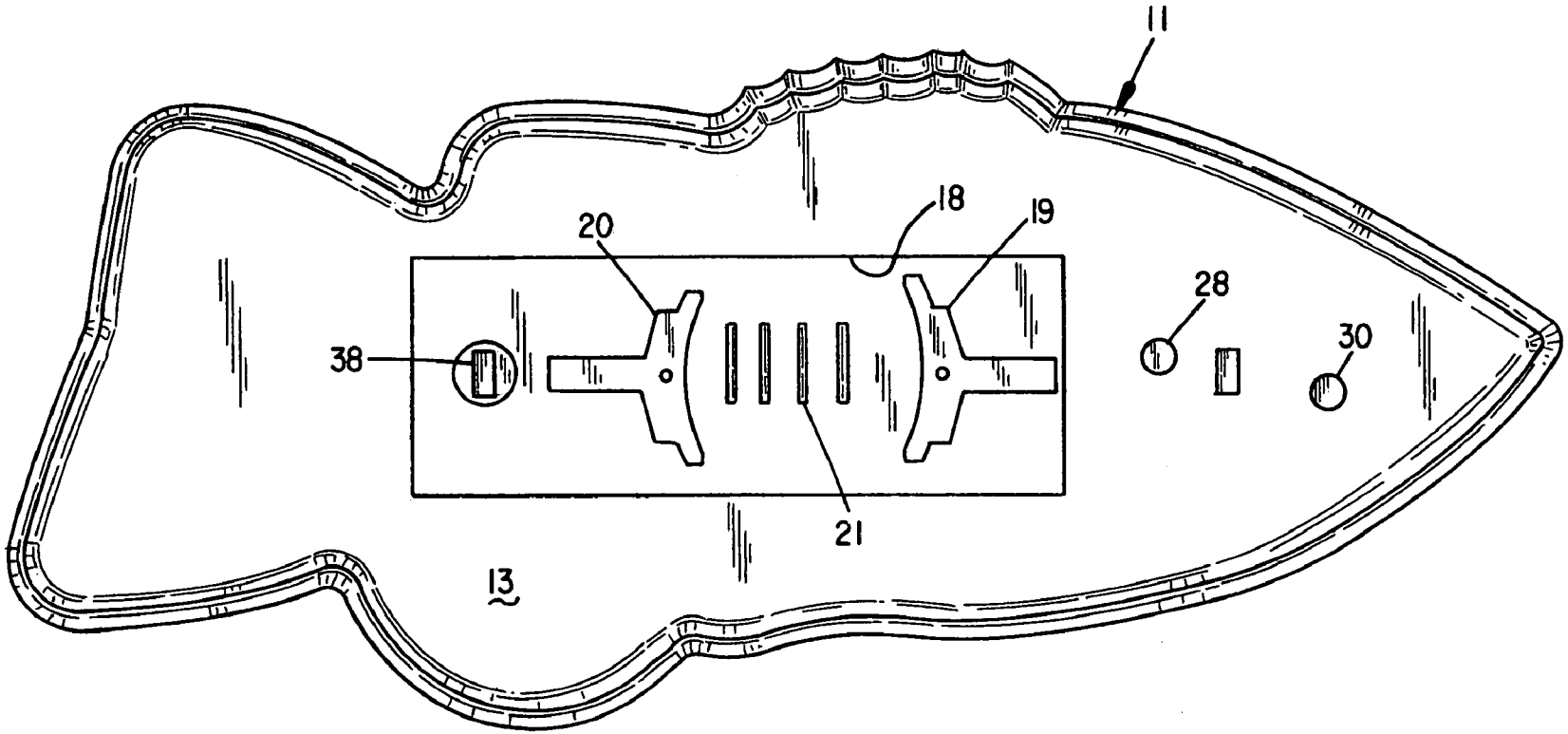
FIG. 4 is a sectional view of the wall decoration and game board apparatus of FIG. 3 taken along the line 4-4 thereof.

As shown in FIGS. 2 and 4, the front surface of the mounting panel 11 has a recessed compartment 18. Compartment 18 is for the purpose of storing stand legs 19, 20, and for storing game playing components. In the example shown the game apparatus is for the game of cribbage. The compartment 18 can hold a plurality of cribbage pegs 21. In the display mode of FIG. 1, the compartment 18 is closed by the game playing surface 17 of the game board 14. The various items are securely held in the compartment 18 and are concealed from view.

Game board 14 is releasably attached to the mounting panel 11. Game board 14 has first and second mounting openings 25, 26. The mounting panel 11 has corresponding first and second mounting openings 28, 30. First and second mounting posts 23, 24 are installed in the mounting openings 25, 26 of the game board 14. The mounting posts 23, 24 can be frictionally held in the mounting openings 28, 30 of the mounting panel 11. The game board 14 is removed from the mounting panel 11 simply by pulling away from the mounting panel against the frictional force holding the mounting posts 23, 24. The game board 14 is reconnected to the mounting panel 11 by inserting the mounting posts 23, 24 and pressing the items together.

Figure 5:
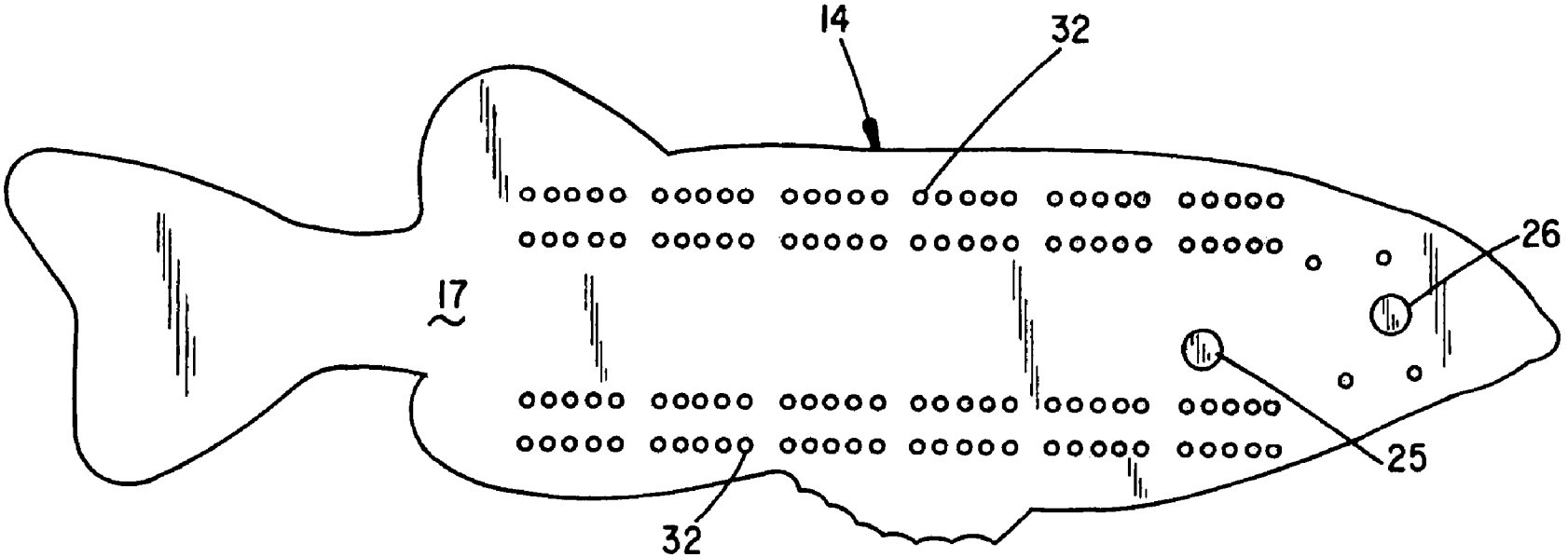
FIG. 5 is a side view of a side of the game board of the wall decoration and game board apparatus of FIG. 3 showing the side with the game playing surface.

FIG. 5 shows the playing surface 17 of the game board 14. In this particular instance the game apparatus is configured for the game of cribbage. Accordingly, the game playing surface 17 of the game board 14 is configured as a cribbage board. The playing surface 17 has a array of cribbage peg openings 32 that can be arranged in a normal cribbage board configuration.

Figure 7:
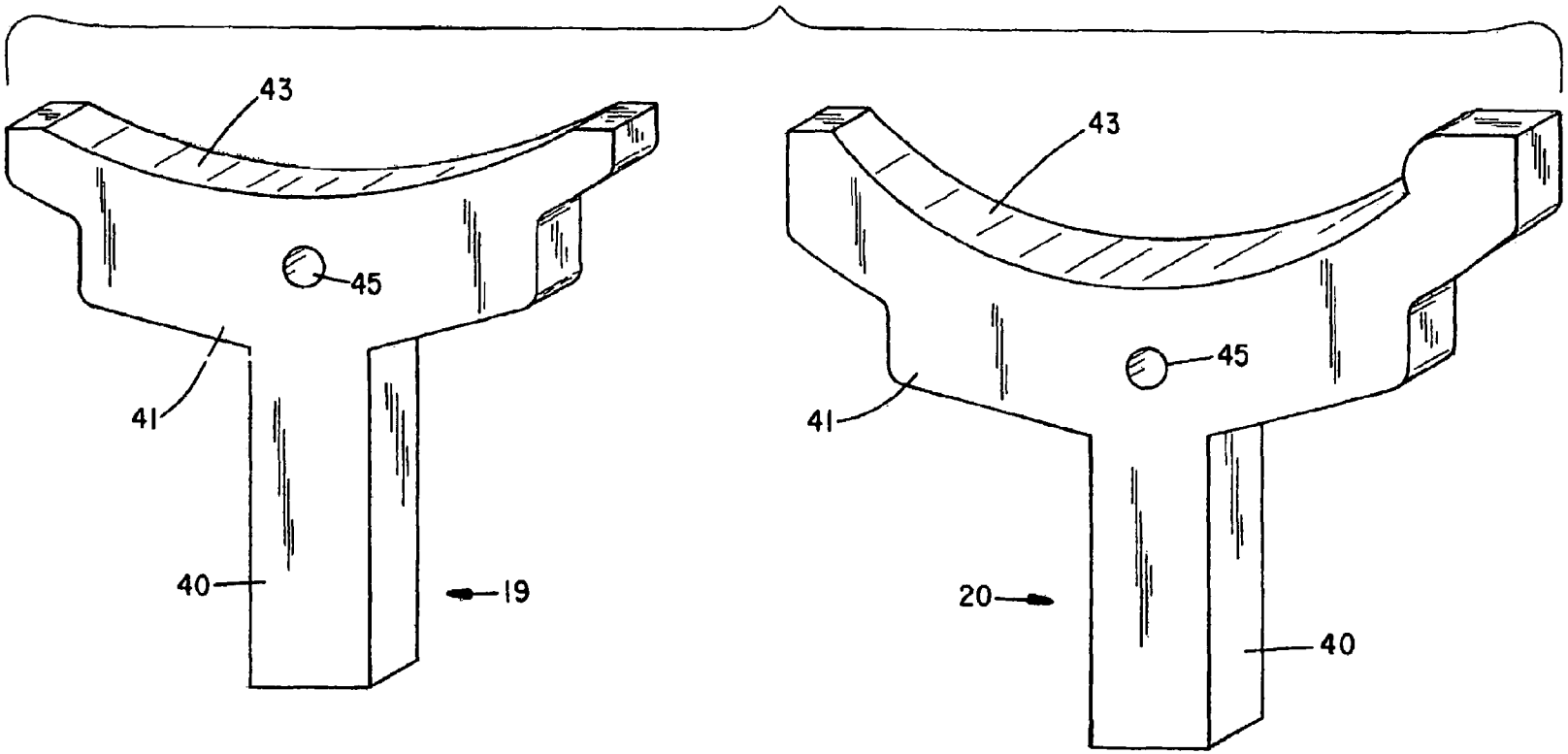
FIG. 7 is a perspective view of the stand legs that support the game board in the game playing mode.

Stand legs 19, 20 are shown in greater detail in FIG. 7. Each stand leg has a neck 40 and a head 41. Mounting panel 11 has leg receiving sockets 37, 38 (FIG. 4). The lower end of necks 40 are configured to frictionally fit in sockets 37, 38. Each head 41 has an upper end formed in the contour of a cradle 43. The cradle 43 is configured to engage a portion of the display surface 15 of the game board 14. The game board 14 securely rests in the cradle 43 with the playing surface 17 facing upward for purposes of playing a game such as the game of cribbage.

Figure 6:
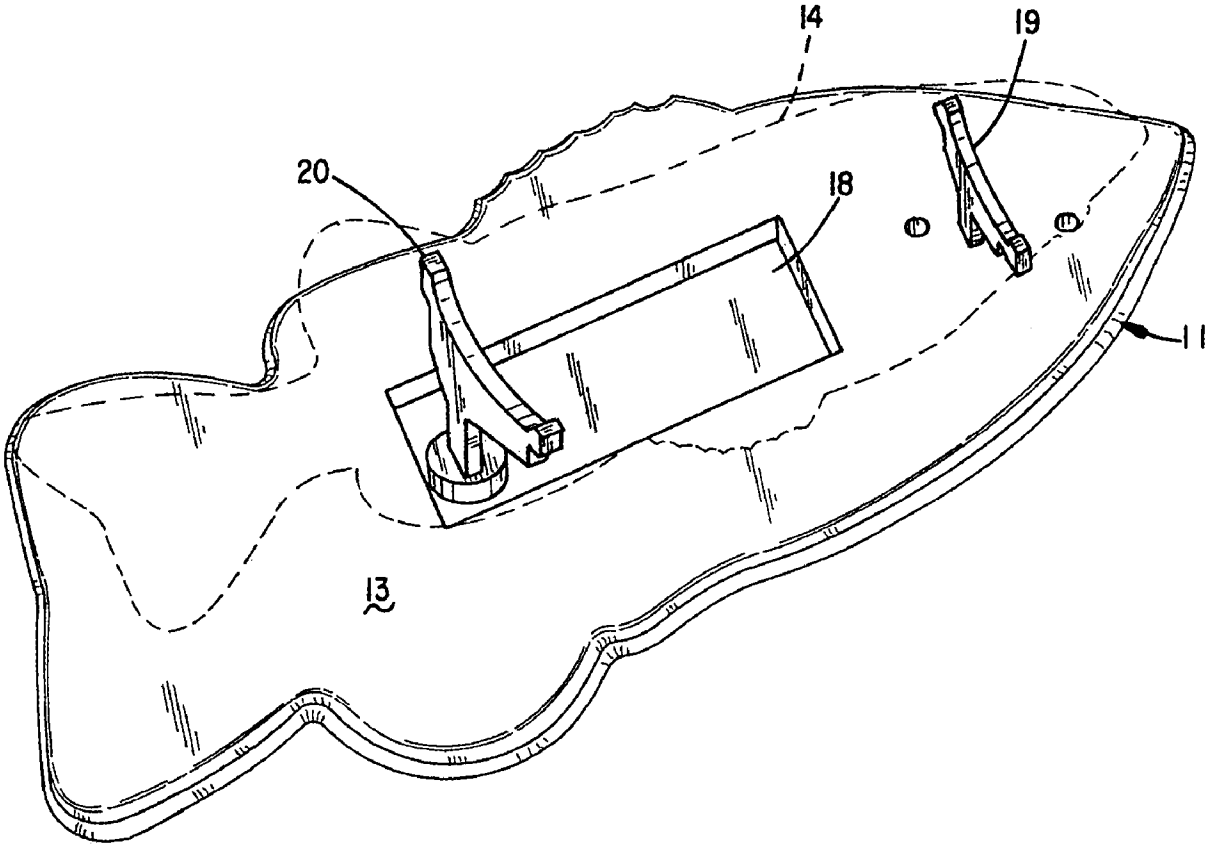
FIG. 6 is a perspective view of the wall decoration and game board apparatus stand in the game playing mode with the game board supported thereon shown in phantom.

FIG. 6 shows the wall decoration and game apparatus of FIG. 1 in an erected configuration or in the game playing mode. In converting from the display configuration of FIG. 1 to the game playing mode of FIG. 6, the playing board 14 is removed from the mounting panel 11. The stand legs 19, 20 are removed from the compartment 18 of the mounting panel 11. The necks 40 of the stand legs 19, 20 are inserted in the sockets 37, 38 of the mounting panel 11. The game board is placed in the cradles 43 of the stand legs 19, 20. The cradles 43 can be configured to intercept a section of the display profile of the display surface 15 of the game board 14. The game playing components are also removed from the compartment 18. In this case, the cribbage pegs 21 are removed from the compartment.

When a game playing session is completed, the apparatus in the game playing mode is disassembled. The stand legs are removed from the erected position with respect to the mounting panel 11 and are replaced in the compartment 18. The stand legs 19, 20 can have openings 45 for positioning over corresponding mounting pegs in the compartment 18 in order to secure the stand legs in the storage position.

Figure 8:
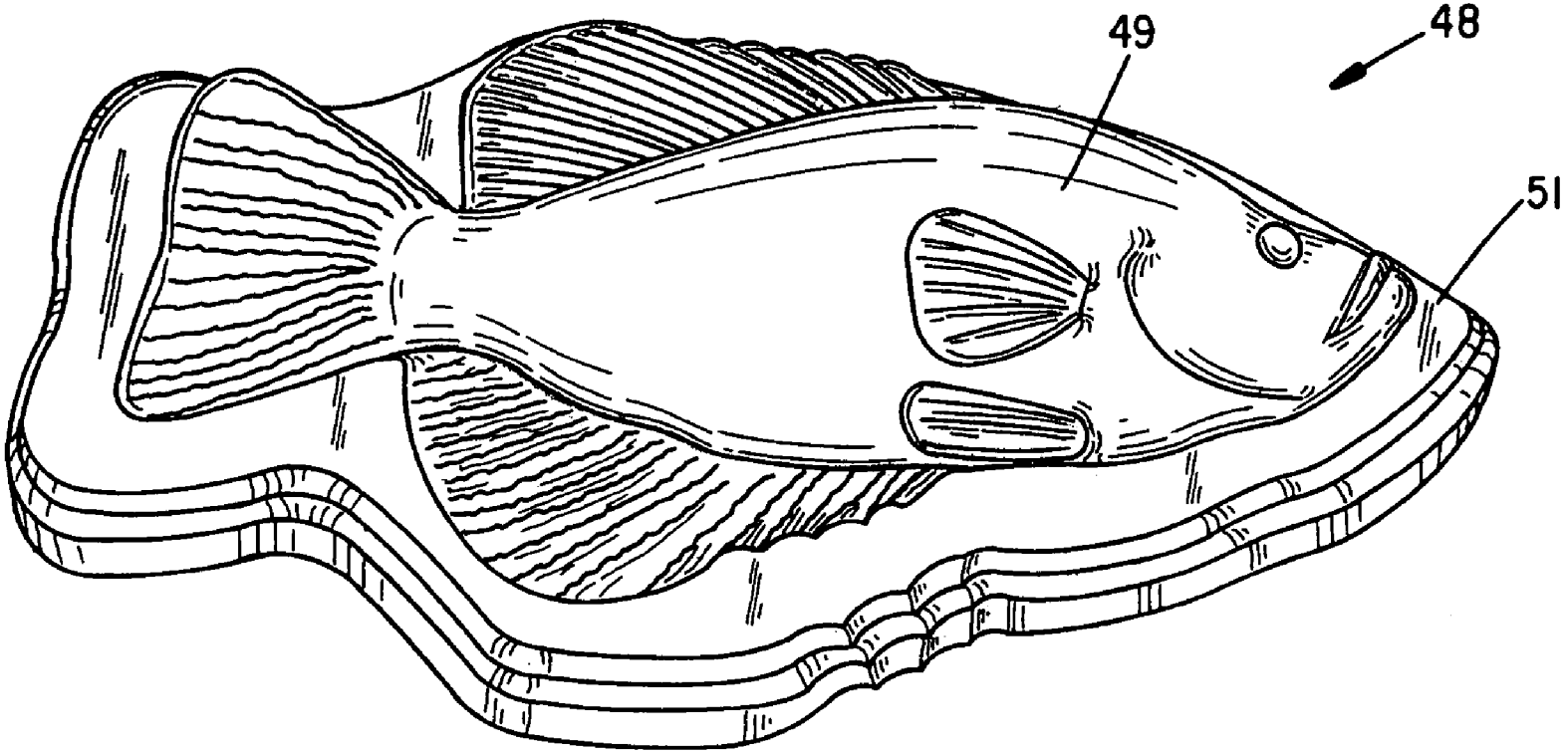
FIG. 8 is a front view slightly in perspective showing another embodiment of a wall decoration and game board apparatus.

FIG. 8 depicts another embodiment of a wall decoration and game apparatus indicated generally at 48. The game apparatus 48 depicts another species of fish or in this instance, a croppy. A game board 49 having a relief of a croppy on the display surface thereof is connected to a mounting panel 51 that can be hung on the wall. Other decorative items such as other game species or non-animal decorative items could be replicated and form the display surface of the game board. The display can generally be a three dimensional replication or relief of the item to be displayed and the game board will have a generally flat game board playing surface that abuts the mounting panel in the display configuration.

Figure 9:
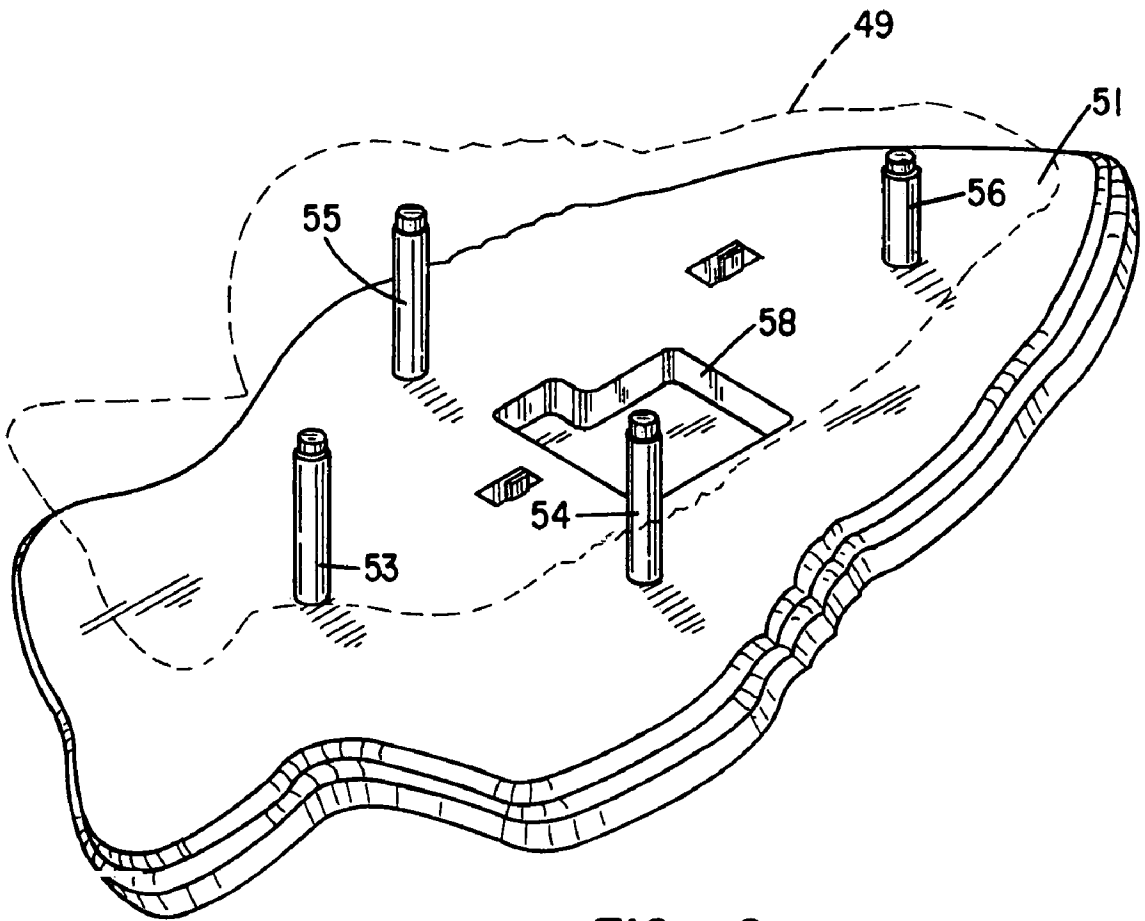
FIG. 9 is a perspective view of the stand of the embodiment of wall decoration and game apparatus of FIG. 8 in the erected game playing mode and showing the game board in phantom.

FIG. 9 shows the stand 51 in the game playing mode and supporting the game board 49 shown in phantom. The game board is supported on a plurality of legs 53, 54, 55 and 56. The legs 53-56 are generally straight posts frictionally held in suitable openings in the top surface of mounting panel 51. The legs surround a storage compartment 58 formed in the mounting panel. The outer ends of the legs form a cradle for the support of the display side of the game board 49. In the example shown the front leg 56 is shorter than the remaining legs 53-55 reflecting the contour of the fish replica of the display side of the game board 49. It may be seen that there could be a mixture of straight legs like those shown in FIG. 9 and one or more legs with cradle heads like those shown in 7 in order to support the game board.

The invention claimed is:

1. A wall decoration and game apparatus convertible between a display mode and a game playing mode, comprising:

a mounting panel that can be hung on a wall, said mounting panel having a back surface that faces the wall when the mounting panel is hung on a wall, and a front surface opposite the back surface;

a game board having a first side with a display surface and a second side opposite the first side with a game playing surface wherein the game board is a cribbage board and has an array of cribbage peg holes;

said display surface has a three dimensional replica of at least a portion of a game animal;

said game board releasably connectable to the mounting panel in a display mode with the second side of the game board abutting the front surface of the mounting panel;

said front surface of the mounting panel having a compartment for storage of game playing items including a plurality of cribbage pegs, said compartment closed by the game board in the display mode;

at least one stand leg that can be stored in the compartment when the mounting panel and game board are in the display mode;

said stand leg having a first end connectable to the mounting panel forming a stand to hold the game board in the game playing mode;

said stand leg having a second end for supporting the game board in the game playing mode.

2. The wall decoration and game apparatus of claim 1 including:

a plurality of stand legs each having a first end connectable to the mounting panel and a second end for supporting the game board in the game playing mode.

3. The wall decoration and game apparatus of claim 2 wherein:

the second end of at least one of the stand legs has a cradle contour for supporting the game board at the display surface with the game playing surface facing up.

4. The wall decoration and game apparatus of claim 2 including:

game playing items stored in the compartment in the display mode.

5. The wall decoration and game apparatus of claim 1 wherein:

the replica of a game animal is a relief of a fish.

6. The wall decoration and game apparatus of claim 5 including:

a plurality of stand legs each having a first end connectable to the mounting panel and a second end for supporting the game board in the game playing mode.

7. The wall decoration and game apparatus of claim 6 wherein:

the second end of at least one of the stand legs has a cradle contour for supporting the game board at the display surface with the game playing surface facing up.

* * * * *